US005867836A

United States Patent [19]

Quiñones

[11] Patent Number: 5,867,836

[45] Date of Patent: Feb. 9, 1999

[54] WAIST BAND TROUSER OR SKIRT HOLDER

[76] Inventor: Luis F. Quiñones, A-9 Lopategui Avenue, Parkville, Guaynabo, Puerto Rico, 00969

[21] Appl. No.: 965,463

[22] Filed: Nov. 6, 1997

[51] Int. Cl.[6] ..... A41F 9/00

[52] U.S. Cl. ..... 2/236; 2/221; 2/919

[58] Field of Search ..... 2/220, 221, 236, 2/237, 311, 919, 920

[56] References Cited

U.S. PATENT DOCUMENTS

| | | | |
|---|---|---|---|
| 2,663,027 | 12/1953 | Posson . | |
| 2,806,225 | 9/1957 | Singer . | |
| 2,905,948 | 9/1959 | Grisanti | 2/237 |
| 2,946,064 | 7/1960 | Dieterle . | |
| 3,027,566 | 4/1962 | Ruby | 2/237 |
| 3,076,201 | 2/1963 | Winter . | |
| 4,089,068 | 5/1978 | Swallow | 2/76 |
| 4,480,339 | 11/1984 | Hubbard | 2/237 |
| 4,498,201 | 2/1985 | Carter . | |
| 4,549,317 | 10/1985 | D'Ambrosio . | |
| 4,677,699 | 7/1987 | Barabe | 2/221 |
| 4,800,594 | 1/1989 | Young | 2/237 |
| 4,890,337 | 1/1990 | Greenberg . | |
| 5,016,291 | 5/1991 | Capper . | |
| 5,304,162 | 4/1994 | Kuen | 604/391 |
| 5,544,366 | 8/1996 | Kato | 2/237 |
| 5,638,550 | 6/1997 | Hube | 2/311 |

*Primary Examiner*—William Stryjewski
*Assistant Examiner*—Shirra L. Jenkins
*Attorney, Agent, or Firm*—D. Peter Hochberg

[57] ABSTRACT

A waist band holder for holding up a pair of trousers or a skirt. The waist band holder has three strips, a fabric strip, an elastic strip and a Velcro strip. The strip of Velcro is attached to the elastic strip. The elastic strip is attached to the fabric strip. Two additional Velcro strips are attached to the end of the waist band trouser holder for securing to a persons waist. The strip of Velcro on the waist band holder attaches to a strip of Velcro on the inner waistband of a pair of trousers or skirt. The elastic strip allows the waist band to displace in the vertical direction when an individual wearing the waistband trouser holder sits or squats. The waist band holder then returns the trousers or skirt to its original position when the wearer returns to a standing position.

8 Claims, 4 Drawing Sheets

WAIST BAND TROUSER OR SKIRT HOLDER

BACKGROUND OF THE INVENTION

1. Field of the Invention

The present invention relates generally to clothing and more particularly to an improved waist band to be worn preferably on the inside of a pair of trousers or on the inside of a skirt.

2. Description of Prior Art

Trousers or skirts ride up and down vertically when a person sits or is bending his or her knees when squatting. Inner or invisible belts are old in the art and are designed to move around the waist to adjust evenly, but do not permit a garment to ride up or down. Therefore, trousers or skirts must be readjusted almost every time a person stands from a sitting or squatting position.

Generally, suspenders with their elastic bands, which allows a garment to ride up or down, is the preferred means for holding trousers in place for many men. However, because of its visibility during wearing and the cumbersome nature of removal, it is not as widely accepted in the marketplace as is the common waist belt. In areas of the world with a warmer climate, the shirt is usually worn loosely and over the trousers. In some cases the suspenders are worn inside the shirt and usually over the undershirt. This causes the suspenders to show through the shirt. This has not been widely accepted, and is a limiting factor in the sales of the suspenders.

The present invention alleviates these problems by providing an economical waist band of simple construction, to be worn on the inside of a pair of trousers or a skirt, that stretches vertically as opposed to horizontally when a person is sitting or squatting. (The term "trousers" used herein includes the term "skirt", unless also mentioned or specifically excluded).

SUMMARY OF THE INVENTION

In accordance with a preferred embodiment, the present invention is a waist band holder designed to hold and return a pair of trousers or skirt to its original waist position by means of an elastic member in the band assembly. The elastic member stretches vertically to allow vertical movement of the trousers or skirt when sitting or squatting. The waist band holder is comprised of a fabric strip, an elastic band or strip and a strip of hook and loop fastener, such as Velcro, each having a front and a rear surface. The rear surface of the elastic band or strip is attached to the front surface of the fabric strip near the top edge of both strips. The remaining surfaces of the fabric strip and elastic band are not attached, so that the bottom edge of the elastic band can be extended vertically. A strip of Velcro is attached to the bottom edge of the front surface of the elastic band. The strip of Velcro is attachable to an opposing Velcro strip affixed to the inside of the waist of a pair of trousers or skirt. Opposing Velcro pieces will be attached to each end of the waist band holder for being adjusted to the waist of the user.

An object of this invention is to provide waistband holder that operates in the same manner as suspenders.

An additional object of this invention is to provide a waist band holder for trousers or skirts that is hidden from sight while the trousers or skirts are being warn.

Another objects of this invention is to provide a waist band holder for trousers that operates in the same manner regardless of whether a shirt is worn tucked in or lying on the outside of the trousers.

A further object of this invention is to provide a waist band holder that is easily removed and easy to install on trousers.

Another object of this invention is to provide a waist band holder that can enhance the figure of a body by pressing around the waist, and reducing the appearance of the size of the stomach.

Another object of this invention is to provide an inexpensive and effective to manufacture waistband holder.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 6:
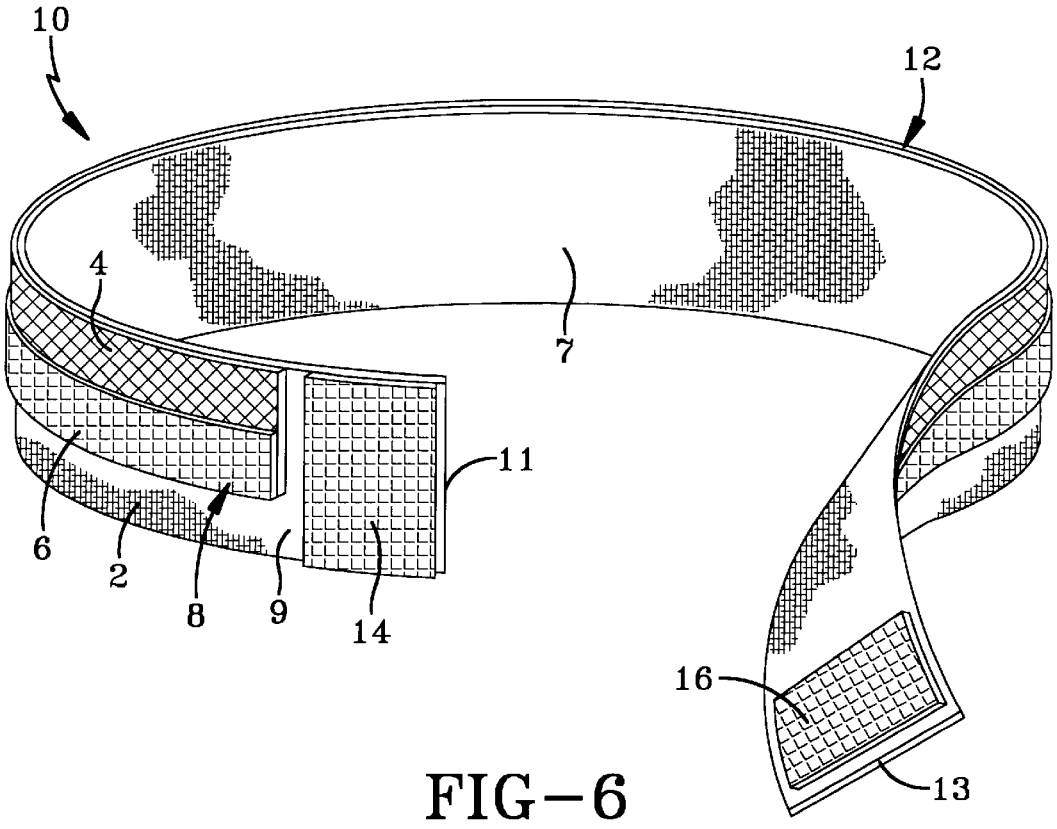
FIG. 6 is a perspective view of a waist band holder unit.

Referring now to the drawings wherein the showings are for the purpose of illustrating the preferred embodiment of the invention only, and not for the purpose of limiting the same, FIGS. 13 shows the necessary components in constructing an example of a waist band trouser holder of the preferred embodiment of the current invention. The components are comprised of a fabric strip 2, an elastic strip 4 and a Velcro strip 6. The strips are of varying width and length, to accommodate varying waist sizes of different individuals. In this example, the width of fabric strip 2 is 3", the width of elastic strip or elastic band 4 is 2", and Velcro strip 6 is 1", while the lengths of the strips vary according to the width of an individuals waist. Each strip has a rectangular configuration and has a front surface, a rear surface, a top edge, a bottom edge and side edges. The front surface faces the body of an individual while the rear surface faces away from the body of an individual when the waist band holder is worn. The fabric strip 2 could be made of silk, cotton, polyester or the like. FIG. 6 shows a completed waist band holder 12 comprised of fabric 2, elastic band 4, and Velcro 6. The waist band holder 12 has a front surface 7, a rear surface 9 and two ends II, 13. A large square piece of Velcro 14 is affixed to rear surface 9 of end II. A smaller rectangular piece of Velcro 16 is affixed to front surface 7 of end 13. The waist band holder 12 is placed around the waist of an individual and is releasably attachable by Velcro pieces 14 and 16. The length of the waist band holder 12 varies with the waist size of an individual. However, the smaller Velcro piece 16 and larger Velcro piece 14 accommodate weight fluctuation within a few sizes.

Figure 1:
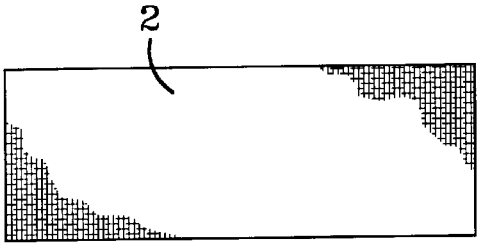
FIG. 1 is a front view of a strip of fabric used in the construction of the preferred embodiment.
Figure 5:
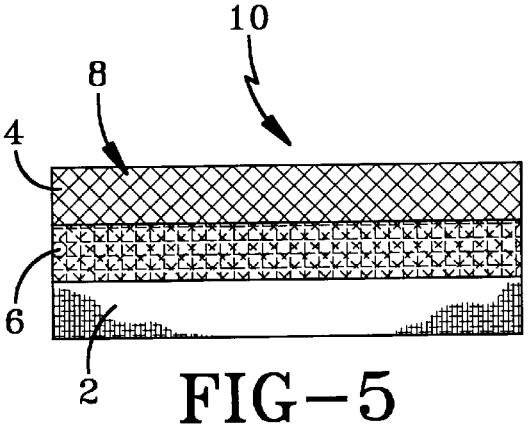
FIG. 5 is a front view of a waist band holder subassembly.
Figure 2:
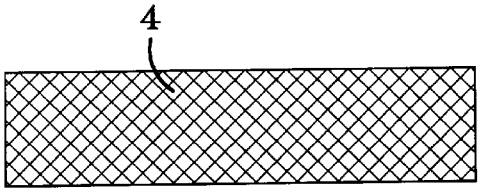
FIG. 2 is a front view of an elastic band or strip used in the construction of the preferred embodiment.
Figure 4:
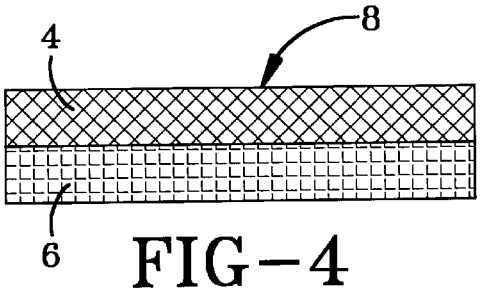
FIG. 4 is a front view of a Velcro-elastic band subassembly.
Figure 3:
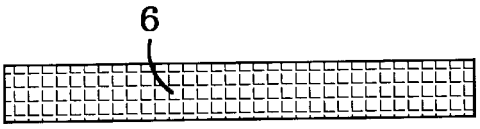
FIG. 3 is a front view of a Velcro strip used in the construction of the preferred embodiment.
Figure 7:
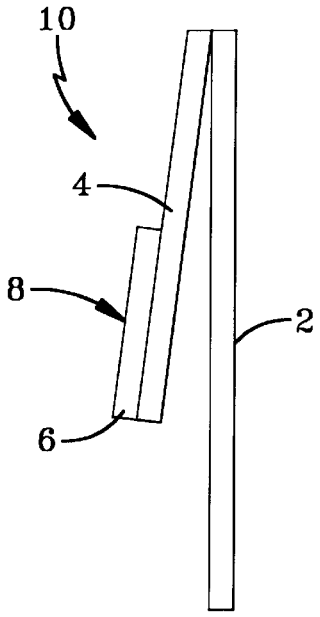
FIG. 7 is a partially exploded cross-sectional view of a waist band holder subassembly.

Assembly of the waistband trouser holder is shown in FIGS. 4–7. FIG. 4 shows the first step of the assembly. The entire front surface of Velcro strip 6 is fastened to the rear surface of elastic strip or band 4, such that the bottoms of both strips are flush with one another, and elastic strip 4 extends upwardly beyond the top surface of Velcro strip 6. Sewing, applying adhesives, using fasteners or any other conventional means may be used for attachment of the two strips together. The strips now form a Velcro-elastic band subassembly 8. FIG. 5 shows the completed second step. Velcro-elastic band subassembly 8 is affixed at the rear surface of elastic band 4 to the front surface of fabric 2 to form a waist band holder subassembly 10. The elastic strip or band 4 is attached to fabric strip 2, such that the tops of elastic band 4 and fabric 2 align with one another. As can be seen in FIG. 7, the Velcro-elastic band subassembly 8 is attached only near the top of the subassembly to fabric 2, so that the remainder of the Velcro-elastic band subassembly hangs loosely from fabric 2. The Velcro strip 6 can now stretch while fabric 2 remains stationary. The final waist band trouser holder 12 is shown in FIG. 6 where mating Velcro pieces 14,16 are attached to the front surface of one end of the combined strips and the rear surface of the opposite end of the combined strips as discussed earlier. The mating Velcro pieces 14, 16 allow for releasable attachment of the waist band trouser holder 12 to an individuals waist. The Velcro mating pieces 14, 16 could be replaced with buttons, snaps, hooks, buckles or the like.

Figure 8:
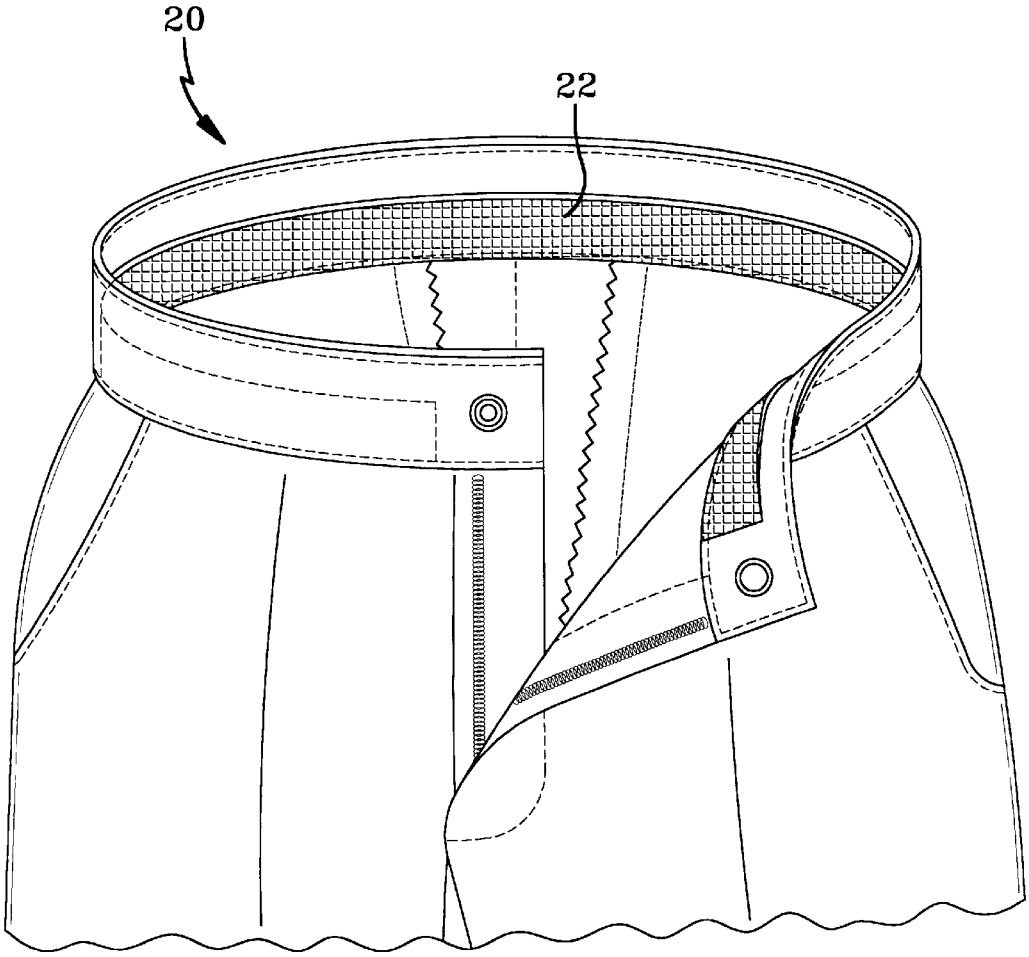
FIG. 8 is a perspective view of a portion of a pair of trousers having a Velcro strip placed around the trousers inner waistband.
Figure 9:
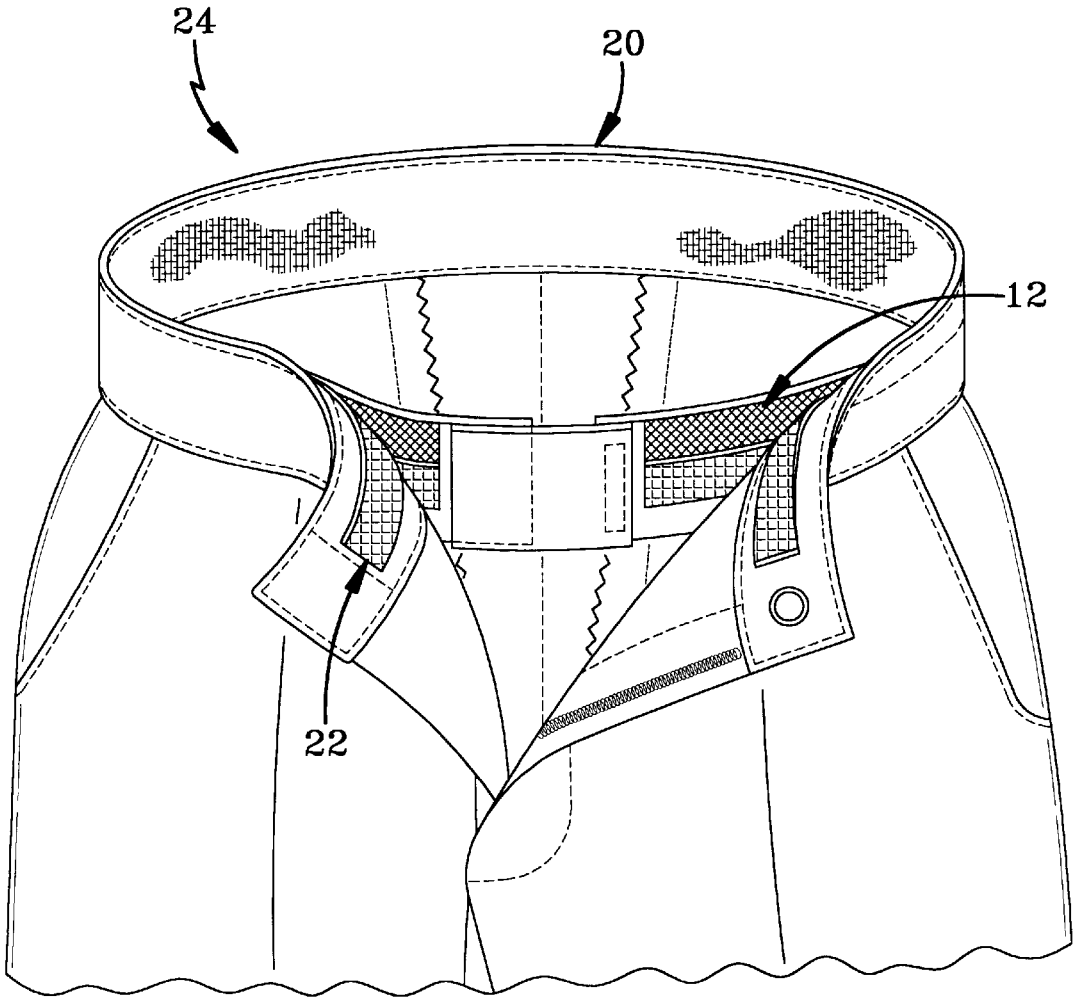
FIG. 9 is a perspective view of the portion of a pair of trousers in FIG. 8 having the waist band holder unit of FIG. 7 inserted.

As shown in FIGS. 6, 8, and 9, a pair of trousers 20 includes a Velcro strip 22 placed around the trouser inner waist band excluding the trouser zipper area. The Velcro strip 22 of trousers 20 releasably attaches to Velcro strip 6 in waist band trouser holder 12. The waist band trouser holder 12 can be assembled to trousers 20 in two ways. The first way is fastening the waist band trouser holder 12 to trousers 20 prior to putting trousers 20 on. Basically, waist band trouser holder 12 is put in place by aligning and pressing together Velcro strip 6 of waist band trouser holder 12 with mating Velcro strip 22 in trousers 20. An individual can put trousers 20 on, adjust waist band trouser holder 12 to the body by applying pressure on Velcro piece 14, 16 against one another, buttoning the trouser waistband, and closing the zipper. The waistband trouser holder 12 and trousers 20 form a complete trouser assembly 24.

The second way is putting on and adjusting waist band trouser holder 12 to the body by putting waist band trouser holder 12 on, adjusting the waist band trouser holder 12, and fastening Velcro pieces 14, 16 to one another. An individual can now put completed trouser assembly 24 on, align and attach Velcro strips 6, 22, button trousers 20, and close the zipper.

The wearer of the waist band holder can now sit or squat, and the waist band holder remains in place around the individuals waist while the trousers ride up or down. After the individual returns to a standing position, the trousers return to the original position before sitting or squatting. The reason is that the elastic waist band stretches vertically with the movement of an individual, and retracts to its original position when force is no longer placed on the elastic band. The elastic band is usually made of loosely woven fabric made flexible by strands of rubber running through it, but may be made of other rubber like material.

An important advantage of the waist band trouser holder is that shirts can be worn inside or loosely outside of the trousers, because the bands primary function will not be affected in any way by the way the shirt is worn. It will still perform its job of holding and returning the trousers or skirts to its original position whenever required, while not being observable when in use.

The waist band holder 12 does not represent any impediment at all to quick removal of the trousers, as trousers 20 and band 12 constitute an assembly 24 when worn and can be removed together. This is accomplished by releasing the band 12 after the waistband button and zipper has been opened. An alternative to getting trousers 20 and band 12 off as an assembly 24, is to get trousers 20 off by releasing the waist band button, opening the zipper and pressing the hands around between the Velcro attachments 6, 22 to get them loose. In this case the trousers 20 will come off the body and waistband 12 will stay on the body.

The foregoing description is a specific embodiment of the present invention. It should be appreciated that these embodiments are described for the purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

What is claimed is:

1. A waistband holder and attachment combination comprising:

a hook and loop fastener strip having a forward surface and a rear surface;

a fastening strip opposing said hook and loop fastener strip on the inside waistband of a pair of trousers or skirt, said forward surface of said hook and loop strip being releasably engageable with said fastening strip;

an elastic strip having a forward surface and a rear surface, said rear surface of said hook and loop fastener strip being affixed to the forward surface of said elastic strip;

a fabric strip having a front surface and a rear surface, said rear surface of said elastic strip being attached to said front surface of said fabric strip at the top edge of said rear surface of said elastic strip;

securing means for securing said waist band trouser holder to the waist of an individual; and said elastic strip being vertically displaced away from said fabric strip when said waistband holder is worn and secured on the waist of an individual and attached by said hook and loop fastener strip to said fastening strip on a pair of trousers or skirt, in response to the sitting or squatting of the individual.

2. A waistband trouser holder according to claim 1, wherein said main fabric is made from a product selected from the group consisting of silk, cotton and polyester.

3. A waistband trouser holder according to claim 1, wherein said elastic strip is an elastic band.

4. A waistband trouser holder according to claim 1, wherein said securing means is hook and loop fastener.

5. A waistband holder for use with a pair of trousers or a skirt having an internally located connecting band, said holder comprising:

a hook and loop fastener strip having a forward surface and a rear surface, said forward surface of said hook and loop fastener strip being releasably engageable with said connecting band;

an elastic strip having a forward surface and a rear surface, said rear surface of said hook and loop fastener strip being affixed to the forward surface of said elastic strip;

a fabric strip having a front surface and a rear surface, said rear surface of said elastic strip being attached to said front surface of said fabric strip at the top edge of said rear surface of said elastic strip;

securing means for securing said waist band trouser holder to the waist of an individual; and said elastic strip being vertically displaced away from said fabric strip when said waistband holder is worn and secured on the waist of an individual and attached by said hook and loop fastener strip to said connecting band on a pair of trousers or skirt, in response to the sitting or squatting of the individual.

6. A waistband trouser holder according to claim 5, wherein said main fabric is made from a product selected from the group consisting of silk, cotton and polyester.

7. A waistband trouser holder according to claim 5, wherein said elastic strip is an elastic band.

8. A waistband trouser holder according to claim 5, wherein said securing means is hook and loop fastener.

* * * * *